United States Patent [19]

Yawberg et al.

[11] Patent Number: 4,817,365

[45] Date of Patent: Apr. 4, 1989

[54] FIBROUS INSULATION BATT PACKAGING MACHINE

[75] Inventors: Richard C. Yawberg, Grand Rapids; James W. Scott, Newark, both of Ohio

[73] Assignee: Owens-Corning Fiberglas Corporation, Toledo, Ohio

[21] Appl. No.: 120,059

[22] Filed: Nov. 13, 1987

[51] Int. Cl.[4] ..... B65B 63/02; B65B 13/20

[52] U.S. Cl. ..... 53/438; 53/434; 53/512; 53/529

[58] Field of Search ..... 53/529, 530, 570, 572, 53/438, 434, 512, 255

[56] References Cited

U.S. PATENT DOCUMENTS

| | | | |
|---|---|---|---|
| 3,065,586 | 11/1962 | Ghiringhelli | 53/529 |
| 3,327,449 | 6/1967 | Hullhorst et al. . | |
| 3,382,643 | 5/1968 | Hullhorst et al. | 53/529 X |
| 3,455,084 | 7/1969 | Broersma et al. | 53/529 |
| 3,458,966 | 8/1969 | Dunbar et al. . | |
| 3,481,268 | 12/1969 | Price et al. | 53/529 X |
| 3,499,261 | 3/1970 | Hullhorst et al. | 53/529 X |
| 3,696,583 | 10/1972 | Tezuka | 53/529 |
| 3,824,759 | 7/1974 | Finn et al. | 53/529 X |
| 3,971,191 | 7/1976 | Hoyland | 53/572 X |
| 4,099,363 | 7/1978 | Wistinghausen et al. | 53/529 |
| 4,241,562 | 12/1980 | Meyer | 53/529 X |
| 4,263,844 | 4/1981 | Hacking | 53/529 X |
| 4,640,082 | 2/1987 | Gill . | |

*Primary Examiner*—Horace M. Culver

*Attorney, Agent, or Firm*—Patrick P. Pacella; Ted C. Gillespie

[57] ABSTRACT

A fibrous insulation batt packaging machine comprises a vacuum chamber, an inlet tube for receiving batts, the inlet tube being defined by (a) a pair of sidewalls, (b) a pair of moveable end walls, and (c) a platen, the platen being mounted for vertical movement, vacuum means for partially evacuating the vacuum chamber thereby causing compression of the batts, vacuum chamber top doors mounted for movement to close the inlet tube, means for moving the platen vertically upward to further compress the batts, means for moving the moveable end walls to open the inlet tube, and pushing means for pushing the compressed batts from the vacuum chamber into a bag.

12 Claims, 4 Drawing Sheets

FIBROUS INSULATION BATT PACKAGING MACHINE

TECHNICAL FIELD

This invention relates generally to machines for packaging fibrous batts of thermal insulation, and more particularly to such machines which use mechanical compression in conjunction with air evacuating means.

BACKGROUND ART

U.S. Pat. No. 3,327,449, issued to Hullhorst and Lockett on June 27, 1967, discloses a machine wherein a stack of batts is mechanically compressed and vacuum is applied by a vacuum shoe along a longitudinal edge portion of the compressed stack. A paper sheet is wrapped around the stack and the vacuum shoe and the edges of the sheet are glued together over the vacuum shoe.

U.S. Pat. No. 3,382,643, issued to Hullhorst on May 14, 1968, discloses apparatus wherein a sidewall vacuum plenum of a compression station is used to move a stack of batts into the compression station from a loading station. A pressure plenum forming a lower platen of the compression station aids movement of a compressed stack by a cross ram into a bag.

U.S. Pat. No. 3,458,966, issued to Dunbar and Hullhorst on Aug. 5, 1969, discloses a method of pneumatically compressing fibrous batts by enclosing a stack in a plastic bag and evacuating air out of the bag endwise. A restraining sleeve is slipped over the bag and stack after they are compressed by ambient air pressure.

U.S. Pat. No. 3,499,261, issued to Hullhorst, Brown, and Mosier on Mar. 10, 1970, discloses three embodiments of packaging apparatus. FIGS. 1 and 2 disclose an open-top chamber into which a wrapping sheet and a stack of batts are placed. Endwall vacuum plenums evacuate air endwise out of the batts. A bottom wall pressure plenum ejects a wrapped stack. FIGS. 3 and 4 disclose means for compressing a stack of batts horizontally while a bottom wall vacuum plenum evacuates air transversely of the batts parallel to their major surfaces. FIGS. 5–10 disclose the apparatus of U.S. Pat. No. 3,382,643 mentioned above.

U.S. Pat. No. 3,824,759, issued to Finn and Smith on July 23, 1974, discloses apparatus wherein stacks of batts are partially compressed between sets of fingers at a loading station and then moved to a compression station having a sidewall vacuum plenum or holding the partially compressed stacks in the compression station while the loading fingers are withdrawn.

DISCLOSURE OF THE INVENTION

In accordance with the invention, a fibrous batt packaging machine is disclosed wherein pneumatic compression of a stack of fibrous batts is accomplished first by air pressure acting on the stack perpendicularly to the major surfaces of the batts, followed by mechanical compression in the same orientation.

BRIEF DESCRIPTION OF THE DRAWINGS

The invention is hereinafter more fully explained, reference being had to the accompanying drawings wherein.

BEST MODE OF CARRYING OUT THE INVENTION

It should be understood that although the invention is shown and described as providing vertically downward movement of the batts, the invention would be equally operable in either horizontal or vertically upward orientations.

Figure 1:
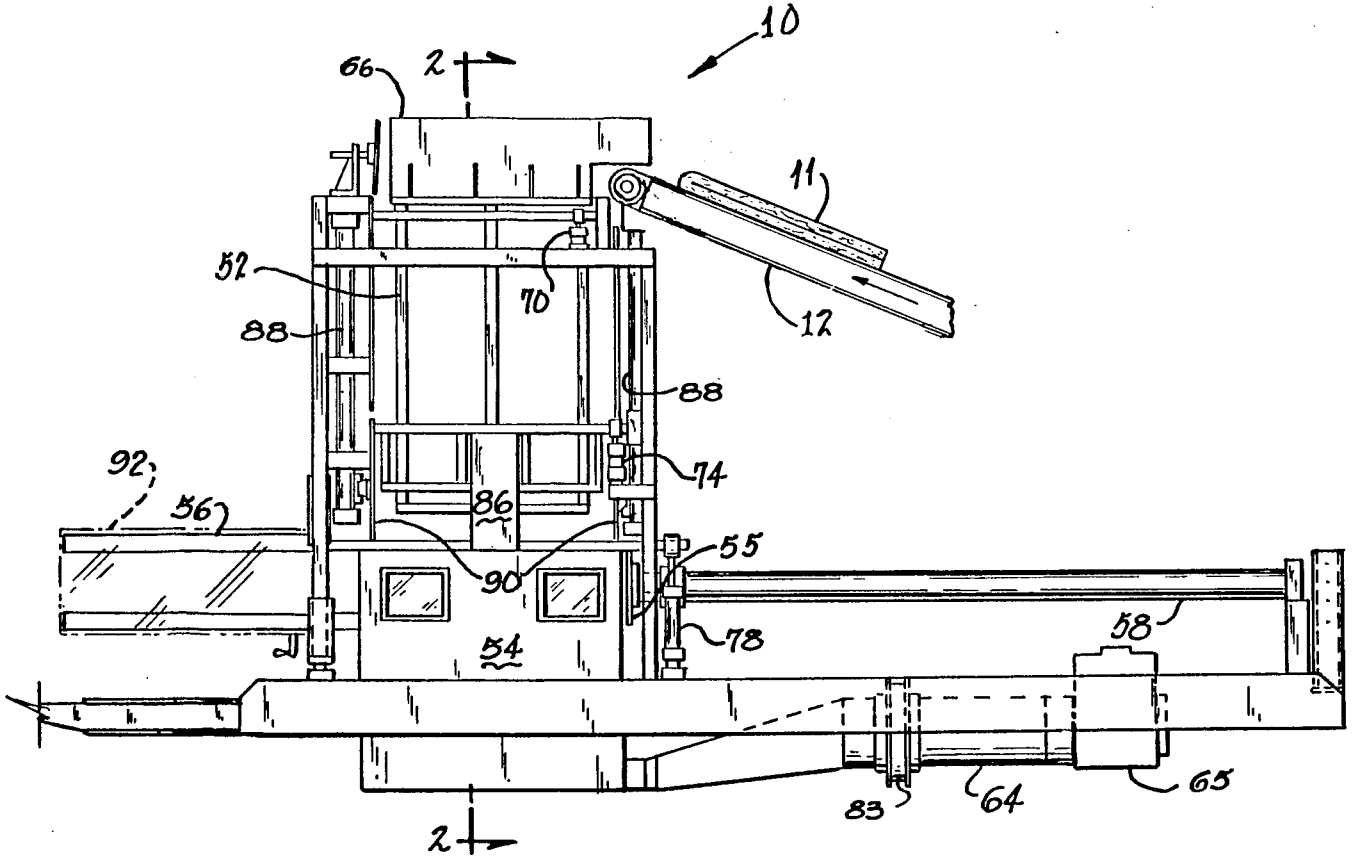
FIG. 1 is a schematic side elevational view of a fibrous insulation batt packaging machine constructed in accordance with the invention.

With reference to the drawings, FIG. 1 shows a packaging machine 10 constructed in accordance with the invention and including an inclined infeed conveyor 12 for receiving fibrous batts 11, for example, from a glass fiber batt forming machine (not shown). The batts can be folded, as shown, or unfolded.

The batts are fed by the infeed conveyor into a stacking framework 52, dropped into a vacuum chamber 54 wherein they are pneumatically and mechanically compressed, and pushed out of the vacuum chamber by a reciprocally mounted pushing plate 55 as a compressed stack into the bagging apparatus 56. The pushing plate 55 is reciprocated by any suitable pushing means, such as pneumatic actuator 58. The vacuum chamber is connected to a duct 64 to which a vacuum pump 65 may be suitably connected. Details of the stacking framework 52 and the vacuum chamber are best shown in FIGS. 2A, 2B and 2C.

Figure 2A:
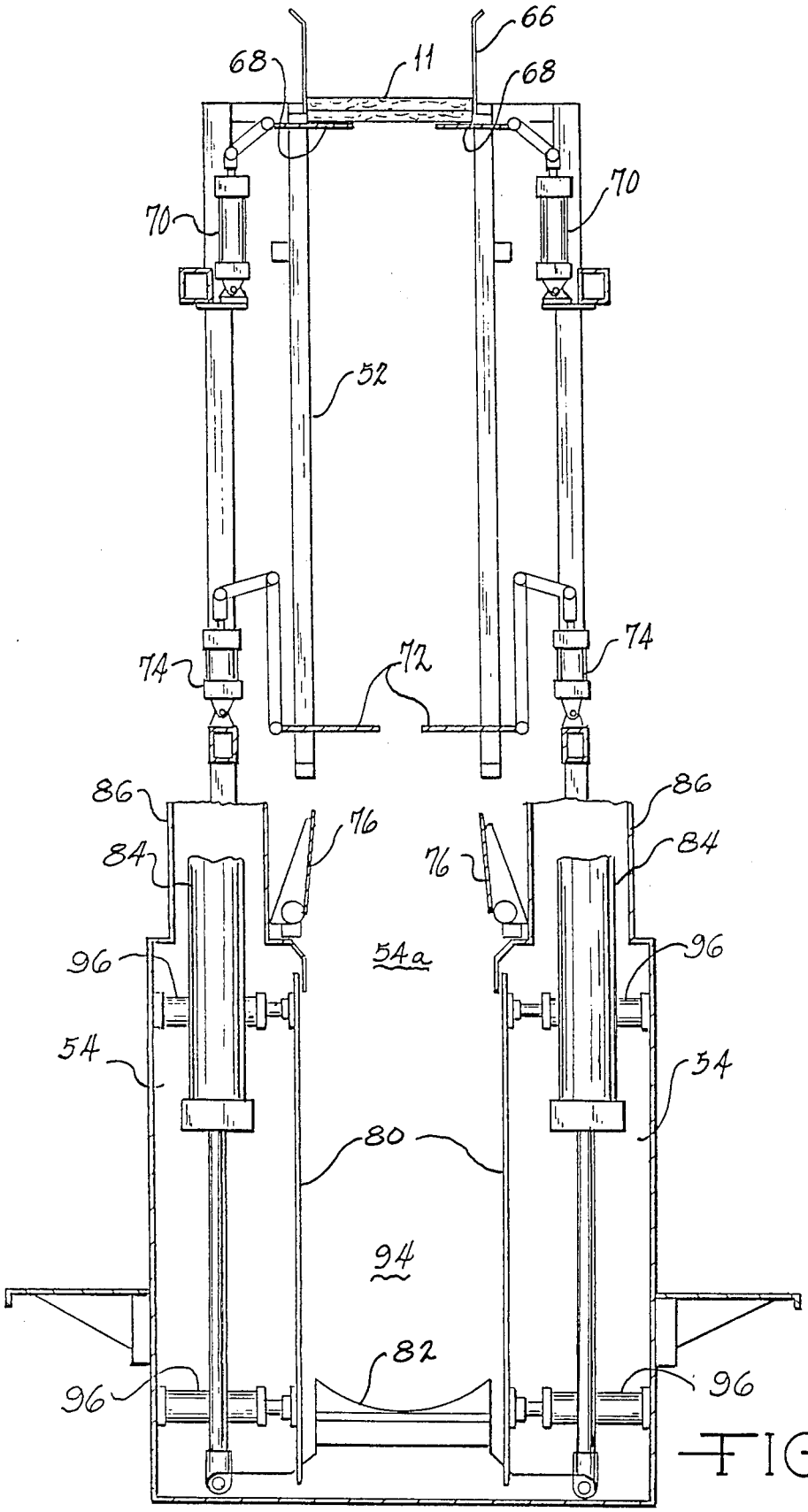
FIGS. 2A, 2B and 2C are vertical sectional views taken generally along the line 2—2 of FIG. 1 and showing various steps in the packaging operation.
Figure 2B:
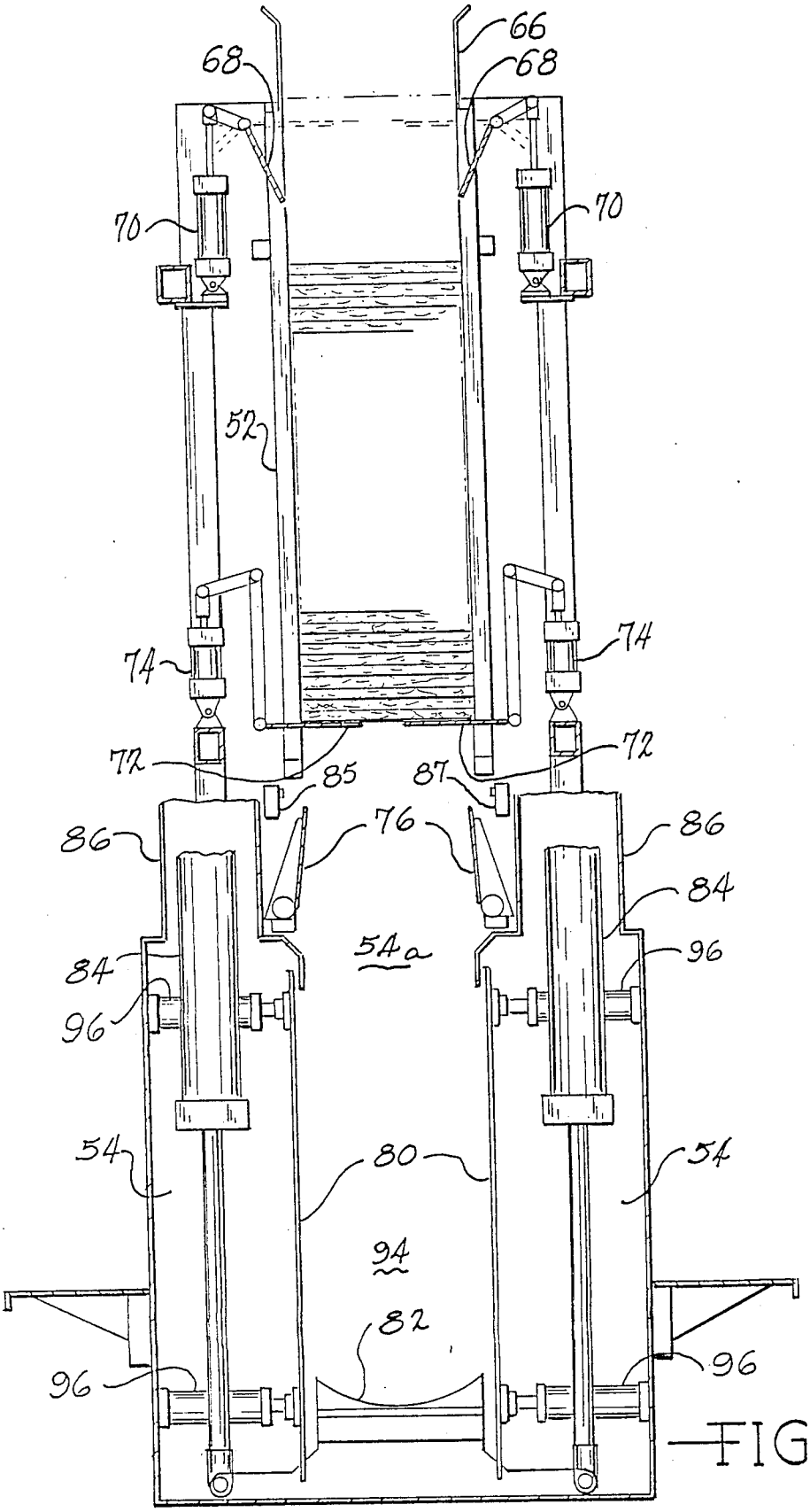
Figure 2C:
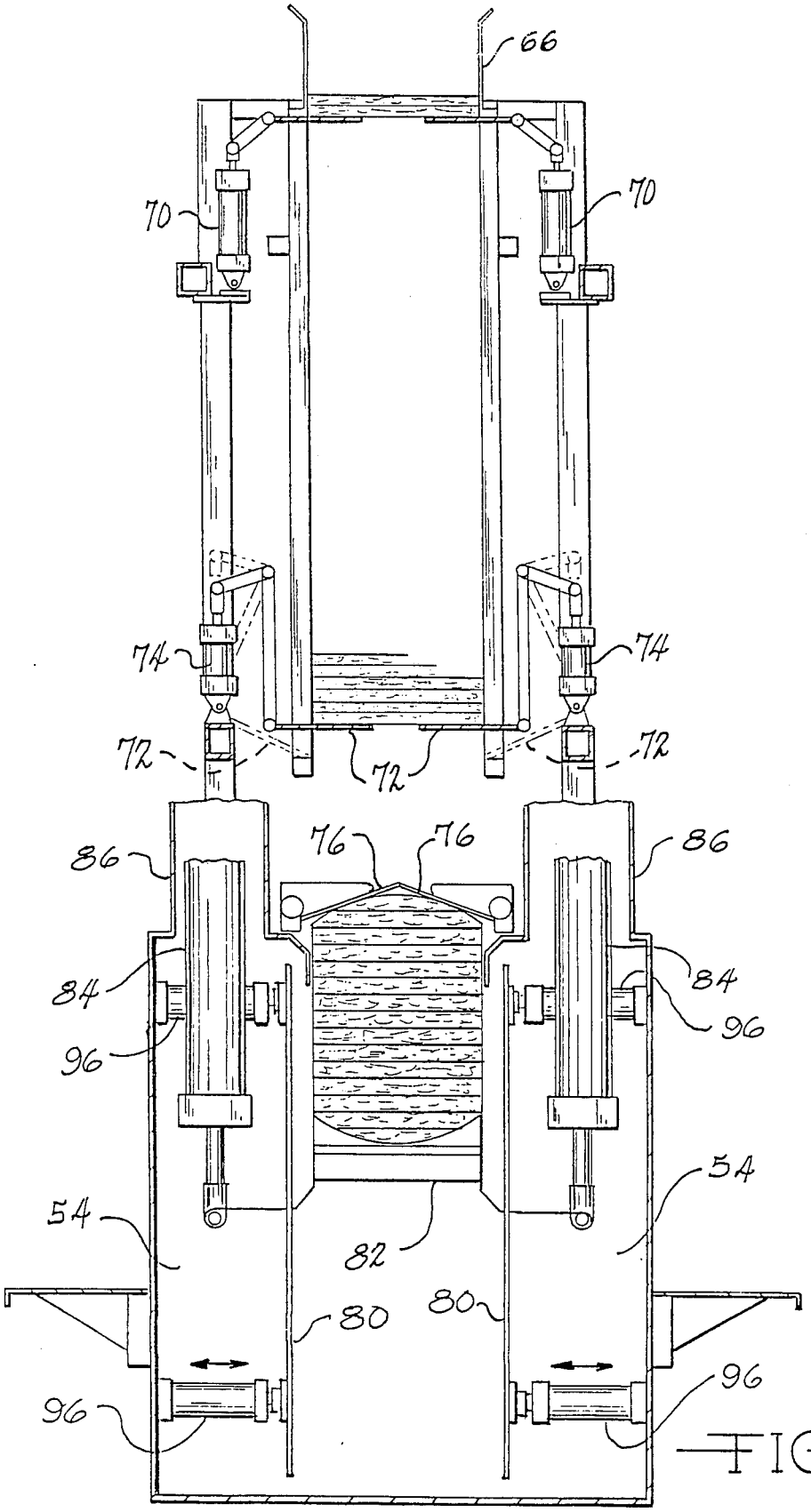

With reference to FIG. 2A, batts are fed successively into a three-sided infeed chamber 66 above the stacking framework 52 where they come to rest initially on a pair of oppositely disposed pivotally mounted upper gate members 68 operatively connected respectively to a pair of pneumatic actuators 70 pivotally mounted on suitable framework adjacent their lower ends. As shown in FIG. 2B, operation of the actuators 70 pivots the gate members 68 downwardly, causing a batt thereon to fall into the stacking framework 52, whereby, after several cycles of the gates 68, a stack of batts is formed on top of a pair of oppositely disposed pivotally mounted lower gate members 72 operatively connected respectively to a pair of pneumatic actuators 74 pivotally mounted on suitable framework adjacent their lower ends.

The machine 10 can be programmed to operate in different manners, depending on the thickness of the batts, whether or not they are folded, and the number to be packaged in each bag. In one example, after a predetermined number of batts has accumulated in a first stack of, for example five batts, resting on the lower gate members 72, the actuators 74 are extended to move the lower gate members 72 to the broken-line positions thereof shown in FIG. 2C, thereby allowing the first stack of five batts to fall into the vacuum chamber. The actuators 74 are then returned to move the lower gate members 72 back into position for accumulation of a second stack of batts thereon.

The vacuum chamber has an opening **54*a* at the top for receiving stacks of batts, the opening 54*a* being closable by a pair of opposed pivotally mounted chamber top doors 76 each operatively connected to a pneumatic actuator 78, one of which is shown in FIG. 1. When the first stack of batts falls into the vacuum chamber, the chamber top doors 76 are open, as shown in FIG. 2A**.

Inside the vacuum chamber are a pair of sidewalls, which are preferably perforated, such as side grills 80, for maintaining batts in alignment while allowing air to be withdrawn therefrom. Most preferably, the side grills are comprised of spread-apart horizontal rods (not shown) to facilitate smooth vertical movement of the batts. Also in the vacuum chamber is a platen 82 mounted for vertical movement. Preferably, the platen is shaped with an upwardly concave surface corresponding with the ultimate shape of the bag of batts. This results in the minimum amount of compression being applied to the batts. The lower surfaces of the closed chamber top doors should also approximate the profile of the finished bag of batts. This can be accomplished either by making the lower surface of the chamber top doors with the exact same contour of the bag of batts, or by providing a slanted straightline surface, as shown in FIG. 2B, which is tangent to the profile of the finished bag of batts. As a result, a stack of compressed batts is compressed substantially only the minimum amount required to package it in a bag. Any suitable means, such as a pair of pneumatic platen actuators 84 fragmentarily shown in FIGS. 2A, 2B and 2C can be used to raise and lower the platen. Preferably, each of the platen actuators is covered by a shroud 86, one of which is shown in FIG. 1.

When the first stack of batts drops into the vacuum chamber, the platen actuators 84 are extended to lower the platen to the broken-line position shown in FIGS. 2A and 2B. A low vacuum is applied to the first stack of batts. The lower gate actuators 74 are then extended and returned again to allow a predetermined number of batts accumulated in a second stack to fall into the vacuum chamber and to allow accumulation of a third stack of batts on the lower gate members 72.

After the second stack of batts falls into the vacuum chamber, an increased vacuum determined by the count of batts is applied to the vacuum chamber. The vacuum pump can be adapted to run continuously, but the amount of vacuum applied to the vacuum chamber is controlled by any suitable means, such as butterfly valve 83 in the duct 64 (FIG. 1).

The lower gate actuators 74 are then extended and returned a third time to allow a predetermined number of batts accumulated in a third stack to fall into the vacuum chamber and to allow accumulation of still another stack of batts on the lower gate members. After the third stack and any subsequent stacks enter the vacuum chamber, the amount of vacuum applied to the vacuum chamber is shifted to a high value determined by the count of the batts.

The vacuum chamber is adapted with means for determining whether or not the batts have moved far enough downward to clear the chamber opening 54*a*. A preferred means is light source 85 (shown in FIG. 2B only) provided at the top of the vacuum chamber, and a corresponding receiver, such as photoelectric cell 87 on the opposite side of the chamber. When the third or final stack is released from the stacking framework and drops toward the vacuum chamber, the light beam falling on the cell is broken, causing the amount of vacuum applied to the vacuum chamber to be further increased to a high value, by full opening of the butterfly valve in the duct 64 (FIG. 1). This causes the batts to be pneumatically compressed by atmospheric pressure at the top of the final stack, until the light beam on the photoelectric cell is restored, whereupon the actuators 78 are extended to close the chamber top doors 76 and the vacuum applied to the vacuum chamber is shut off by the closing of the butterfly valve.

The next step is mechanically further compressing the batts to the final compression value. This can be accomplished by retracting the platen actuators to raise the platen from the broken-line position shown in FIGS. 2A and 2B to the full-line position shown in FIG. 2C, further compressing the batts mechanically against the closed chamber top doors. It should also be understood that the mechanical compression could be effected by movement of the chamber top doors toward the plate. Vacuum chamber end gates 90 can be raised by any suitable means, such as two pneumatic actuators 88 as shown FIG. 1. In their lower positions (not shown) the endgates close an outlet opening from the vacuum chamber to the bagger 56, and also close the inlet opening from the vacuum chamber to the pushing plate 55.

After the end gates are raised, actuator 58, is extended first to push the compressed stack of batts into a bag 92 on the bagger 56 and then to push the bagged batts and the bag off the bagger. Subsequently, actuator 58 is retracted. The actuators 88 are then operated to lower the end gates 90, the actuators 78 are retracted to open the chamber top doors, the actuators 84 are extended to lower the platen to the full-line position shown in FIGS. 2A and 2B, and a new bag is placed on the bagger for the beginning of a new cycle.

The open chamber top doors, the portions of the end gates 90 vertically commensurate therewith, and the side grills 80 form inlet tube 94 for the batts. The stacking framework 52 and the inlet tube are vertically mounted in line so that once the batts reach the infeed chamber, they are moved only vertically during the entire compression process and are not moved horizontally until after the final compression of the batts prior to bagging. When a batt is in the inlet tube, the batt occupies substantially the full cross-sectional area of the inlet tube, whereby maximum use is made of the pressure differential for compressing the batt.

After all the batts have been placed in the inlet tube, and prior to the final compression step by the platen, the side grills 80 can be moved a short distance away from the pack by any suitable means, such as hydraulic actuators 96. This will reduce the contact between the side grills and the paper flanges on the insulation batts.

It should be understood that the batch method of feeding the batts into the vacuum chamber and inlet tube could be replaced by a more or less continuous feed method. In such a method batts are continuously fed into the vacuum chamber. When the appropriate sensor (such as the photocell 87) determines that the stack in the vacuum chamber is too high, the vacuum is turned on. As more batts are added to the stack the vacuum is automatically increased to keep the top batt always below the predetermined level.

Various modifications may be made in the structure shown and described without departing from the scope of the invention as set forth in the following claims.

We claim:

1. A fibrous insulation batt packaging machine comprising a vacuum chamber, an inlet tube for receiving batts, the inlet tube being defined by (a) a pair of sidewalls, (b) a pair of moveable endwalls, and (c) a platen, the platen being mounted for vertical movement and the endwalls and side walls forming a rectangular inlet tube cross-section which is substantially the same size as that of the batts, vacuum means for partially evacuating the vacuum chamber thereby causing compression of the batts, vacuum chamber top doors mounted for movement to close the inlet tube, means for mechanically further compressing the batts, means for moving the moveable endwalls to open the inlet tube, and means for pushing the compressed batts from the vacuum chamber into a bag.

2. The machine of claim 1 in which the platen is mounted for movement and in which the means for mechanically further compressing the batts comprises means for moving the platen.

3. The apparatus of claim 2 in which the means for moving the platen is adapted to move the platen vertically upward.

4. The machine of claim 1 in which the sidewalls are mounted for movement away from the stack of batts in the inlet tube.

5. The machine of claim 1 in which the upper surface of the platen and the lower surface of the chamber top doors are shaped to approximate the final shape of the bag of batts.

6. A fibrous insulation batt packaging machine comprising a vacuum chamber, an inlet tube for receiving batts, the inlet tube being defined by (a) a pair of sidewalls and (b) a pair of moveable end walls, the endwalls, and sidewalls of the inlet tube forming a rectangular inlet tube cross-section which is substantially the same size as the cross-section of the batts, a stacking framework for accumulating batts at a position above the inlet tube, the stacking framework being positioned above the inlet tube and having substantially the same cross-section as that of the inlet tube, vacuum means for partially evacuating the vacuum chamber and thereby causing compression of the batts, vacuum chamber top doors mounted for movement to close the inlet tube, means for moving the moveable end walls to open the inlet tube, and means for pushing the compressed batts from the vacuum chamber into a bag, the stacking framework and the inlet tube being mounted in line so that the batts are moved only vertically until after the final compression of the batts prior to bagging.

7. The machine of claim 6 in which the sidewalls are mounted for movement away from the stack of batts in the inlet tube.

8. The method for packaging fibrous insulation batts comprising depositing batts into an inlet tube positioned in a vacuum chamber, the inlet tube being defined by (a) a pair of sidewalls, (b) a pair of moveable endwalls, and (c) a platen, partially evacuating the vacuum chamber to cause compression of the batts, closing vacuum chamber top doors to close the inlet tube, moving the sidewalls away from the stack of batts in the inlet tube, mechanically further compressing the batts, moving the moveable endwalls to open the inlet tube, and pushing the compressed batts from the vacuum chamber into a bag.

9. The method of claim 8 in which the mechanical compressing of the batts is effected by moving the platen.

10. The method of claim 9 in which the platen is moved vertically upwards.

11. A fibrous insulation batt packaging machine comprising a vacuum chamber, an inlet tube for receiving batts, the inlet tube being defined by (a) a pair of sidewalls, (b) a pair of moveable endwalls, and (c) a platen, the platen being mounted for vertical movement and the sidewalls being mounted for movement away from the stack of batts in the inlet tube, vacuum means for partially evacuating the vacuum chamber, thereby causing compression of the batts, vacuum chamber top doors mounted for movement to close the inlet tube, means for mechanically further compressing the batts, means for moving the moveable endwalls to open the inlet tube, and means for pushing the compressed batts from the vacuum chamber into a bag.

12. A fibrous insulation batt packaging machine comprising a vacuum chamber, an inlet tube for receiving batts, the inlet tube being defined by (a) a pair of sidewalls, (b) a pair of moveable endwalls, and (c) a platen, the platen being mounted for vertical movement, vacuum means for partially evacuating the vacuum chamber, thereby causing compression of the batts, vacuum chamber top doors mounted for movement to close the inlet tube, means for determining when the evacuation of the vacuum chamber has compressed the batts sufficiently to enable closure of the vacuum chamber top doors, means for mechanically further compressing the batts, means for moving the moveable end walls to open the inlet tube, and means for pushing the compressed batts from the vacuum chamber into a bag.

* * * * *